US007491014B2

(12) United States Patent
Sick

(10) Patent No.: US 7,491,014 B2
(45) Date of Patent: Feb. 17, 2009

(54) SYSTEM AND METHOD OF THE AUTOMATIC COMPACTION OF SOIL

(75) Inventor: Georg Sick, Feldafing (DE)

(73) Assignee: Wacker Construction Equipment AG, Munich (DE)

( * ) Notice: Subject to any disclaimer, the term of this patent is extended or adjusted under 35 U.S.C. 154(b) by 158 days.

(21) Appl. No.: 10/553,569

(22) PCT Filed: Apr. 7, 2004

(86) PCT No.: PCT/EP2004/003743

§ 371 (c)(1),
(2), (4) Date: Jun. 9, 2006

(87) PCT Pub. No.: WO2004/090232

PCT Pub. Date: Oct. 21, 2004

(65) Prior Publication Data

US 2007/0025815 A1 Feb. 1, 2007

(30) Foreign Application Priority Data

Apr. 14, 2003 (DE) ..... 103 17 160

(51) Int. Cl.
*E01C 19/35* (2006.01)
*E02D 3/046* (2006.01)

(52) U.S. Cl. ..... 404/133.1; 404/83; 404/84.2; 404/133.05; 405/271

(58) Field of Classification Search ..... 404/84, 404/84.2, 133.05, 133.1; 405/271
See application file for complete search history.

(56) References Cited

U.S. PATENT DOCUMENTS 4,600,999 A * 7/1986 Ito et al. ..... 701/25
5,646,844 A * 7/1997 Gudat et al. ..... 701/208
6,088,644 A * 7/2000 Brandt et al. ..... 701/50
6,113,309 A * 9/2000 Hollon et al. ..... 404/84.5
6,213,681 B1 * 4/2001 Sick et al. ..... 404/133.05
6,243,039 B1 * 6/2001 Elliot ..... 342/457
6,263,750 B1 * 7/2001 Maurer et al. ..... 74/61
6,282,362 B1 * 8/2001 Murphy et al. ..... 386/46
6,287,048 B1 * 9/2001 Hollon et al. ..... 404/84.2
7,256,388 B2 * 8/2007 Eglington et al. ..... 250/221
RE39,834 E * 9/2007 Kieranen et al. ..... 404/84.5
7,354,221 B2 * 4/2008 Congdon ..... 404/84.1

(Continued)

FOREIGN PATENT DOCUMENTS

DE 100 53 446 A 6/2002

(Continued)

*Primary Examiner*—Raymond W Addie

(57) ABSTRACT

The invention relates to a soil compacting system which comprises a travelling and steerable soil compacting device and a control device. The control device is provided with an area definition device which allows a user to establish an area to be compacted and the area boundaries. A position detecting device detects the actual position of the soil compacting device. A traveler changes the direction of travel of the soil compacting device by presetting a standard value for a travelling movement of the soil compacting device in such manner that the soil compacting device does not travel past the respective area boundary but continues its travel within the area. A path planning device may be provided for fixing a presetting for a travel way which makes sure that the soil compacting device, when keeping to the preset travel way, travels at least once completely across the area to be compacted.

30 Claims, 5 Drawing Sheets

U.S. PATENT DOCUMENTS

| | | | | |
|---|---|---|---|---|
| 2004/0022582 | A1* | 2/2004 | Sick | 404/133.05 |
| 2005/0085241 | A1* | 4/2005 | Bahl et al. | 455/456.1 |
| 2005/0086211 | A1* | 4/2005 | Mayer | 707/3 |
| 2005/0258240 | A1* | 11/2005 | Chappidi et al. | 235/385 |
| 2007/0025306 | A1* | 2/2007 | Cox et al. | 370/338 |

FOREIGN PATENT DOCUMENTS

| | | | |
|---|---|---|---|
| EP | 0 761 886 | A | 3/1997 |
| FR | 2 697 098 | A | 4/1994 |

* cited by examiner

SYSTEM AND METHOD OF THE AUTOMATIC COMPACTION OF SOIL

BACKGROUND OF THE INVENTION

1. Field of the Invention

The present invention relates to a system and a method for automated soil compacting.

2. Description of the Related Art

From DE 100 53 446 A1, a mobile soil compacting device whose direction of travel is stabilized is known. The device has a motion acquisition apparatus for detecting the actual travel movement of the soil compacting device. The actual travel movement is compared with a target value predetermined by the operator. Any deviations that may occur, due e.g. to disturbances, are automatically corrected by a travel regulation device. In this way, the soil compacting device, e.g. a vibration plate or a roller, stably follows a travel path that is predetermined by the operator.

Due to the stabilization of the travel direction, the operator is already significantly relieved of stress during his work. In particular, brief, stochastic disturbances of the travel of the soil compacting device (here a vibrating plate) are automatically regulated out, so that the operator does not have to take any countermeasures when the soil compacting device briefly deviates from the predetermined course. However, the compacting in particular of larger surfaces still requires increased concentration on the part of the operator in order to drive the soil compacting device in a rational manner and to ensure that the surface is completely compacted. Due to the relatively slow forward motion of the soil compacting device, this work can be strenuous and fatiguing. It is therefore desirable to further improve the operating comfort.

From U.S. Pat. No. 6,113,309, a roller device made up of a plurality of roll tires is known that automatically travels a predetermined path, thus compacting the soil. The predetermination of the compacting path takes place either using mechanical devices, e.g. markings on the soil that is to be compacted, or through GPS data that were previously acquired during the application of the asphalt to be compacted. The goal of the described solution is to cause the roller device to travel as precisely as possible along the side edge of the asphalt in order to achieve a uniform compacting.

OBJECT AND SUMMARY OF THE INVENTION

The underlying object of the present invention is to indicate a soil compacting system and an associated method with which the operability and operator comfort, as well as the economical affordability, of a soil compacting device can be further improved.

According to the present invention, this object is achieved by a soil compacting system according to Claim 1, as well as by methods for automatic soil compacting according to Claims 27 and 28. Advantageous constructions of the present invention are defined in the dependent claims.

According to the present invention, the soil compacting system is equipped with a mobile and steerable soil compacting device, e.g. a vibration plate or a roller, and a control device, the control device having a surface definition device, a position detection device, and a motion controller. The surface definition device is used by the operator to define a surface to be compacted, as well as the associated boundaries of the surface. It is thus possible for the operator to input indications concerning the surface to be compacted into the soil compacting system, or to communicate the surface boundaries to the system in some other way.

The position detection device is used to detect the current position of the soil compacting device; it must at least be possible to detect the position of the soil compacting device in the vicinity of the surface boundaries, i.e., when a close approach is made to the boundaries of the surface.

Finally, the motion controller can be used to change the direction of travel of the soil compacting device. For this purpose, a target value for a travel movement is given to the soil compacting device by the motion controller in such a way that the soil compacting device does not cross the respective surface boundary, but rather continues its travel within the surface. If in this way the soil compacting device approaches one of the boundaries of the surface, and there is a danger that given unchanged travel the soil compacting device would cross the surface boundary, the motion controller can, by changing the direction of travel, introduce the appropriate measures to prevent the surface boundary from being crossed. For this purpose, the motion controller can be subject to various rules that are further explained below.

In a particularly advantageous specific embodiment of the present invention, the position detection device is fashioned at least for the detection of an approach of the soil compacting device to one of the surface boundaries, the direction of travel being capable of being changed by the motion controller if the position detection device determines that the surface boundary is being approached.

Due to the fact that the position detection device only has to determine when the soil compacting device is approaching a surface boundary, but does not however permanently detect the actual position of the soil compacting device within the overall surface, the position detection device can be constructed comparatively simply, and thus inexpensively. The position detection device need emit a signal only when the soil compacting device approaches the respective surface boundary, e.g., when a predetermined distance value of one meter is undershot.

This signal is received by the motion controller, which thereupon introduces measures for changing the direction of travel in order to prevent crossing of the surface boundary.

The surface definition device can enable a definition of the surface boundaries with the aid of mechanical, optical, magnetic, inductive, or capacitive means. Particularly simple is for example an identification of the surface boundaries using a stretched wire over which the soil compacting device may not travel. An antenna acting as a position detection device, or a suitable sensor, can determine when the soil compacting device is approaching the wire, and can transmit the required approach signal to the motion controller.

Alternatively, the surface boundaries can for example also be defined by spray-painted colored markings or by laser beams, in which case the position detection device has optical means (photodetectors, cameras, or the like) for the evaluation of the optical signals.

It is particularly advantageous if the motion controller effects a change of the travel direction from the original travel direction with a predetermined angle that remains constant during the entire compacting process. This means that when a surface boundary is reached, the vibration plate turns to the left or to the right at the predetermined angle, and travel then continues in a straight line. Here of course it must be ensured that the turning direction is not selected such that after the turning the soil compacting device will continue to tend to cross the nearby surface boundary. Therefore, it can be particularly advantageous if the angle of change is an acute angle, less than 90°, so that the soil compacting device is "reflected" by the surface boundary at an acute angle.

Alternatively, in another specific embodiment of the present invention it is possible for the turning angle to be different in each case, and to be selected randomly or from a predetermined table by the motion controller.

These measures are suitable to ensure a random coverage of the surface to be compacted by the soil compacting device. Over the course of time, in this way it is possible to travel over almost the entire surface. If, towards the end of the compacting process, some isolated areas of soil have not yet been traveled, and therefore have not yet been compacted, the operator can intervene manually in order to compact these areas in a targeted fashion.

In another, particularly advantageous specific embodiment of the present invention, a path planning device is provided in order to define a predetermined value for a travel path (course) based on the defined surface, the soil compacting device traveling over the surface to be compacted completely at least once while adhering to the predetermined travel path.

This means that on the basis of the indications stored in the surface definition device concerning the surface to be compacted and the associated surface boundaries, a travel path can be planned that the soil compacting device must follow in order to travel over the surface to be compacted. The travel path planning can be carried out in automated fashion with computer support, also taking into account the width of the soil compacting device. However, for surfaces having a simple outline it is also possible to leave the path planning to the operator. The operator merely needs to indicate the travel path coordinates, e.g. by drawing the travel path on a surface displayed on a screen.

Advantageously, the position detection device is fashioned for the constant detection of the current position of the soil compacting device within the surface boundaries. This means that the position detection device always knows the exact position, and possibly even the direction of travel, of the soil compacting device.

In this specific embodiment, the motion controller is fashioned such that it determines a target value for a travel movement of the soil compacting device on the basis of a comparison of the current position of the soil compacting device, communicated by the position detection device, with the predetermined travel path indicated by the path planning device. This target value is selected such that the soil compacting device follows the predetermined travel path.

In this particularly advantageous specific embodiment, it is thus possible, after inputting the coordinates of the surface to be compacted, to define a travel path that the soil compacting device follows automatically. The motion controller ensures that the position of the soil compacting device does not deviate from the predetermined travel path. Rather, by influencing the drive mechanisms of the soil compacting device, in particular the advance and steering mechanisms, the motion controller can ensure that the soil compacting device follows the predetermined path.

In a particularly advantageous specific embodiment of the present invention, the surface definition device has a coordinate detection device for determining absolute geographical locus coordinates of its current location. In addition, a memory device with geographical locus information concerning the region of the surface to be compacted is coupled to the surface definition device.

In this way, it is possible for the surface definition device to prepare required locus information concerning the region in which the surface to be compacted is located, and to present this information to the operator if necessary. For example, the surface definition device can determine its location with the aid of a GPS receiver, and can read out associated locus data from a magneto-optical storage medium (CD-ROM, DVD-ROM) and display this data to the operator on a display device. It is then easy for the operator to input, on the display screen, the necessary indications for the definition of the surface to be compacted. For this purpose, it is advantageous if the surface boundaries can be defined by absolute locus coordinates.

The definition of the surface boundaries in terms of absolute locus coordinates is also useful in particular if the position detection device also determines the absolute locus coordinates of the soil compacting device. The respective coordinates can then be suitably brought into accord with one another.

The travel path predetermination, in turn, can be defined by the path planning device in the form of absolute or relative geographical locus coordinates. Relative geographical locus coordinates have the advantage that, on the basis of a reference point, relative indications (angles, directions, compass points, travel distances) are sufficient to define the travel path.

If the path planning is to take place in automated fashion, it is useful if the path planning device has mathematical algorithms for path-optimized and/or time-optimized path planning. Due to the fact that certain tolerances will occur in any case during the travel of a soil compacting device, the demands on the optimization algorithms need not be set very high. Thus, for most cases it is sufficient if the algorithms plan a back-and-forth movement of the soil compacting device, or a meander-shaped or spiral-shaped travel path.

It is particularly advantageous if at least a part of the components of the control device, in particular the surface definition device, the motion controller, or the path planning device, are situated so as to be spatially separate from the soil compacting device. By its nature, the soil compacting device is exposed to strong vibrations. If the named components can be set up not on the soil compacting device itself, but rather spatially separate therefrom, more sensitive electronic components can be used that would quickly become damaged if they were used in the vicinity of a vibration exciter of the soil compacting device.

In order to communicate the required data between the components, in particular between the motion controller and the soil compacting device, a radio path, laser path, or infrared path can advantageously be used. This path should be used to communicate at least the target value from the motion controller.

It is particularly advantageous if, in addition, an input device is provided for the manual modification of the target value predetermined by the motion controller. In this way, it is possible for the operator to disable the automatic controlling of the soil compacting device by a manual intervention, for example when a dangerous situation threatens to occur, so that the soil compacting device then obeys only manual commands.

In a further construction of the present invention, the position detection device is coupled to a memory device, possibly provided spatially separate from the soil compacting device, in order to store data concerning the positions reached by the soil compacting device. These data can for example be absolute geographical locus coordinates.

The stored data can for example be given to an evaluation device that, taking into account the data of the surface definition device, represents the achieved compacting, for example graphically. For this purpose, the predetermined surface boundaries can be shown on a display by the evaluation device, as can the surface already compacted by the soil compacting device at the respective point in time. This makes it very easy for the operator to determine whether the soil compacting device has traveled and compacted the predetermined surface in the desired manner. Of course, the graphic display can also take into account the width of the soil compacting device, and thus the width of the compacted track.

In a particularly advantageous specific embodiment of the present invention, the soil compacting system uses a soil compacting device as is known for example from DE 100 53 446 A1. As stated above, such a soil compacting device has a travel direction stabilization that makes it possible for the soil compacting device to follow exactly the path predetermined by an operator.

For this purpose, the soil compacting device has a drive mechanism, comprising for example a vibration exciter, for producing an advance motion, a steering device for producing a yaw moment about a vertical axle of the soil compacting device, and a movement detection device for detecting an actual value of the travel movement. In addition, a travel regulation device is provided that can be provided with the actual value and the target value predetermined by the motion controller of the soil compacting system, and that controls the steering device, or the travel drive mechanism, in such a way that the difference between the actual value and the target value is minimized.

The soil compacting device known from DE 100 53 446 A1 is thus further developed by the present invention. While in that device, the determination of the target value is carried out by the operator via remote control, according to the present invention the target value is predetermined by the motion controller, which attempts to move the soil compacting device within the area that is to be compacted. The travel direction stabilization known from DE 100 53 446 A1 makes the work of the motion controller easier, because disturbances during the soil compacting, due e.g. to uneven ground, stones, cross-forces, etc., are immediately regulated out by the soil compacting device itself, and do not cause the soil compacting device to deviate from the predetermined course.

In this way, the soil compacting device according to the present invention has at least two control loops. The outer control loop comprises the motion controller, and ensures that the soil compacting device follows a particular path or course. The path can be a more or less randomly determined path within the boundaries of the surface to be compacted, or can be a travel path predetermined precisely by the path planning device. In contrast, the inner control loop is coupled directly to the soil compacting device, and recognizes even slight deviations from a travel direction predetermined by the outer control loop, given rectilinear or curved travel of the soil compacting device. The combination of the two control loops makes it possible to move the soil compacting device on the surface to be compacted in a very precise manner.

The mechanical construction of a vibration plate suitable for use as a soil compacting device is known, and is described in detail in DE 100 53 446 A1, so that repetition here is unnecessary. In any case, it is useful if the soil compacting device has a vibration exciter having two shafts that are parallel to one another and that are positively connected so as to be capable of rotation in opposite directions, each shaft bearing an imbalance mass, and whose phase position to one another is adjustable. By adjusting the phase position, it is possible to effect a traveling movement of the vibration plate in the forward and backward directions.

It is particularly advantageous if two imbalance masses that can be adjusted with respect to their phase position to one another are situated in an axially offset manner on at least one of the shafts of the vibration exciter. This forms a steering device with which it is then possible to set the phase position of the imbalance masses to one another, thereby producing a yaw moment about the vertical axle of the vibration plate, resulting in a rotation of the vibration plate over the soil.

Due to the highly developed travel regulation device, it is possible not only to cause the vibration plate to travel back and forth, or to rotate in a stationary position; rather, it is also possible to precisely travel curved radii by superposing the advance movement and the yaw moment. This particular advantage makes the soil compacting system according to the present invention useful for the realization of optimized travel paths on the surface to be compacted, in particular in combination with the path planning device.

In an advantageous further development of the present invention, a plurality of vibration-exciting devices are provided in the vibration plate that operate according to the same two-shaft principle described above. Here it is advantageous if the advance direction of at least one of the vibration-exciting devices differs from that of the other. Through well-directed individual controlling of the individual vibration-exciting devices, it is then possible to move the vibration plate in various directions without having to rotate the soil contact plate, which touches the soil, over the soil. Rather, the relative position of the soil contact plate to the soil is maintained, while the soil contact plate, and thus the overall vibration plate, is moved in the desired direction on the basis of the action of the respective vibration-exciting devices. The vibration-exciting devices not being used for advance or for steering can here be set such that they produce only a vertical oscillation, which can be used exclusively for soil compacting, as is also described in DE 100 53 446 A1.

In a particularly advantageous construction of this variant, the soil contact plate charged by the vibration-exciting devices has an essentially circular outline. This outline makes it particularly easy to move the vibration plate uniformly in all compass directions.

As already stated above, the soil compacting system according to the present invention can be used to realize two alternative methods for automated soil compacting:

In a first method according to the present invention, the soil compacting device is moved automatically within the surface boundaries, preferably in a straight line, and an approach of the soil compacting device to one of the surface boundaries is detected. When a surface boundary is approached, there takes place an automatic change of the direction of travel of the soil compacting device such that the soil compacting device does not cross the respective surface boundary, but rather continues its travel within the surface.

In the second method according to the present invention, it is likewise possible first to define the surface boundaries of the surface to be compacted, the data representing the surface boundaries being capable of being stored. On the basis of these data, a specification for a travel path is planned with which it is ensured that the soil compacting device completely covers the surface to be compacted at least once while adhering to the predetermined travel path. Finally, the soil compacting device is automatically moved along the predetermined travel path.

The previously described constructions of the present invention are essentially intended to achieve a geometrical predetermination or influencing of the travel path of the soil compacting device. In a particularly advantageous further development of the present invention, it is possible, as an alternative or in addition, to detect the state of compacting of the soil and to use this as a criterion in the path planning. This is possible in particular at the point over which the soil compacting device is currently traveling. Thus, for example it is known to draw conclusions about the state of compaction of the soil from the reaction forces acting on a soil contact plate of the soil compacting device, or on the basis of its damping behavior. It is also possible to recognize the extent to which the soil has already been compacted on the basis of changes in this behavior. In this connection, a compaction result detection device 19 is provided for detecting the actual state of compaction of the compacted soil. See for example DE 100 46 336 A 1, WO-A-98-17865, and WO-A-95-10664, in which such possibilities for determining the state of compaction are discussed.

The information obtained in this way about the actual state of compaction of the soil is compared with a target value that the operator can input via a suitable input medium, but for example also by remote control or via a computer (laptop). If it is recognized that the actual compaction state exceeds the target compaction state, and thus that the desired compaction has been achieved in this area of the soil, the path planning device can carry out a modification of the predetermined travel path in such a way that the relevant area of the soil is not traveled over again. In this way, through combination of, on the one hand, the surface definition data of the soil to be compacted and the position data of the soil compacting device with, on the other hand, the determined compaction data, it is possible for the path planning device to define a strategy for predetermining a path-optimized or time-optimized travel path for the movement of the soil compacting device. This is helpful in particular when a plurality of passes of the soil compacting device over the soil is required.

These and other advantages and features of the present invention are explained in more detail below with the aid of the accompanying Figures.

DETAILED DESCRIPTION OF THE PREFERRED EMBODIMENTS

Figure 1:
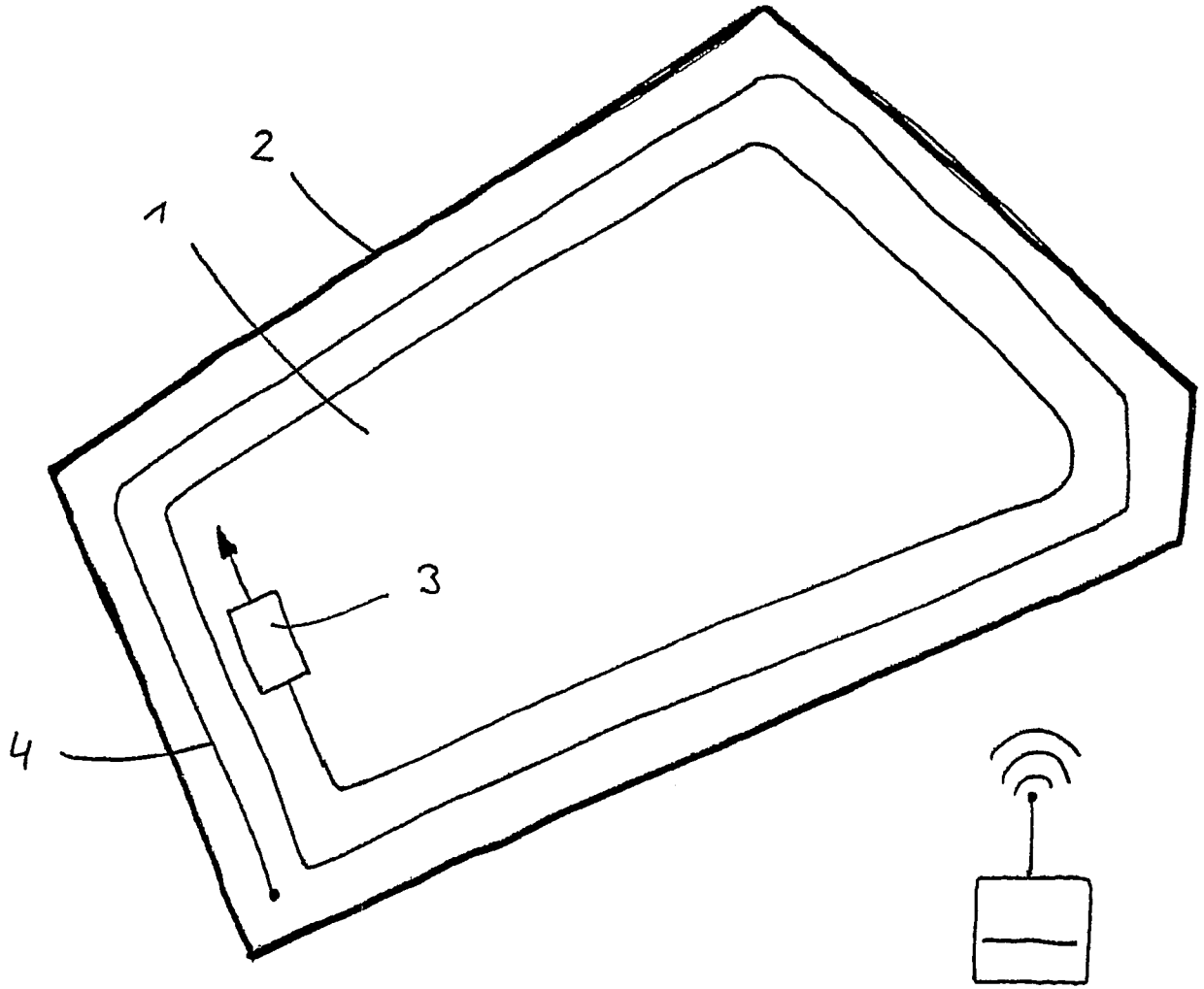
FIG. 1 shows a schematic top view of a surface to be compacted, for the explanation of a first specific embodiment of the present invention.

FIG. 1 shows, in a schematic top view, a surface 1 to be compacted that is enclosed or defined by surface boundaries 2 that are invisible in reality.

Surface 1 is made up for example of loosely piled soil consisting of gravel or earth that is to be hardened through compacting by a soil compacting device 3. As a soil compacting device 3, a known vibration roller or a vibration plate is suitable in a standard manner. Soil compacting device 3 has at least one vibration exciter with which a roll tire drum (in the case of the roller) or a soil contact plate (in the case of the vibration plate) is charged with a preferably vertical oscillation. The soil compacting principle has long been known and has proved its usefulness, so that further explanation is not necessary.

FIG. 1 shows that soil compacting device 3 has been moved along a travel path 4 within surface boundaries 2, and in this way has already compacted a part of surface 1. In the example shown in FIG. 1, travel path 4 runs essentially in a spiral shape. Of course, it is also possible to compact surface 1 using other travel paths, e.g. a meander-shaped path, a back-and-forth movement of soil compacting device 3, a zigzag path, or even completely random traveling over surface 1.

For the controlling of soil compacting device 3, among other means it is known to provide a remote control device 5 that communicates control commands to soil compacting device 3 via a cable or in wireless fashion via a radio, infrared, or laser path, thus monitoring the forward, backward, or steered movement of soil compacting device 3. Standardly, remote control device 5 is held by an operator who can use it to make the desired control commands.

According to the present invention, however, remote control device 5 has significantly more components and functions than is known from the prior art. This is illustrated in connection with FIG. 2.

Figure 2:
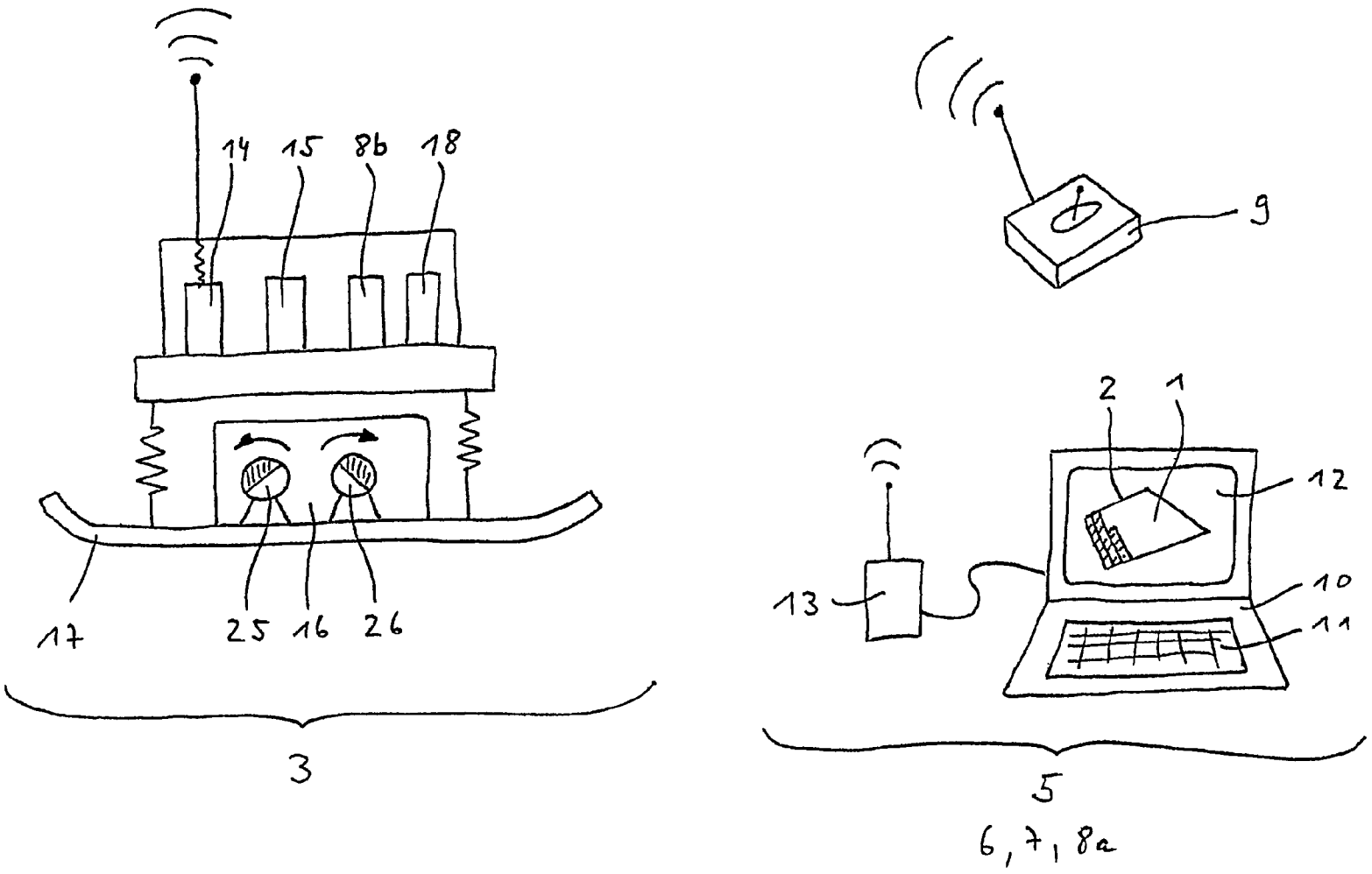
FIG. 2 shows a schematic representation of a soil compacting system according to the present invention, in the first specific embodiment.

According to FIG. 2, remote control device 5 (also called the control device) has, among others, a surface definition device 6, a path planning device 7, a motion controller 8*a*, and an additional input device 9. In particular the surface definition device 6, path planning device 7, and motion controller 8*a* can be situated particularly advantageously as software in a computer 10, e.g. a laptop, having an input device 11 and a display 12.

Via a transmitter 13, remote control device 5 is coupled to a receiver 14 on soil compacting device 3 via a radio, infrared, or laser path, said receiver forwarding the control signals received from remote control device 5 to a travel regulation device 15.

Travel regulation device 15 of soil compacting device 3 is used to control a vibration exciter 16 that introduces, in a known manner, a vertical oscillation into a soil contact plate 17 for the purpose of soil compacting. Vibration exciter 16 is made up of what is known as a two-shaft exciter, in which shafts 25, 26 are coupled with one another in positive fashion so as to be capable of rotating in different directions, each shaft bearing at least one imbalance mass. Besides the production of the vertical oscillation for soil compacting, vibration exciter 16 is also used to produce a force in the direction of travel (forward or backward), as well as to produce a yaw moment about the vertical axle of soil compacting device 3 in order to produce a steered movement. Such a vibration exciter 16 is known for example from DE 100 53 446 A1, as well as from DE-G 78 18 542.9, so that further explanation is not necessary.

In addition, a position detection device 18 for detecting the current position of soil compacting device 3 is provided on soil compacting device 3. Position detecting device 18 can for example be a GPS receiver. Alternatively, it is possible for position detecting device 18 to be spatially separated from soil compacting device 3, e.g. situated on remote control device 5, in which case means (laser, radar) must then be provided with which position detection device 18 can determine relatively precisely the current location of the soil compacting device.

If position detection device 18 is situated on soil compacting device 3, it is sufficient for it to be fashioned for the determination of absolute geographical locus coordinates of its own location. If, however, position detection device 18 is set up externally to soil compacting device 3, it must of course be able to determine the locus coordinates of the respective location of soil compacting device 3.

It is also possible to situate motion controller 8*a* on soil compacting device 3 instead of in remote control device 5 (reference character 8*b*). However, it is of fundamental importance that all electronic devices should be situated as far as possible from soil compacting device 3, in order to avoid damage to them due to the strong vibrations of vibration exciter 16. Thus, as far as possible the required data should be generated at remote control device 5, and should then be communicated only for the controlling of vibration exciter 16 to soil compacting device 3, via receiver 14 and travel regulation device 15.

In the following, the method according to the present invention is explained on the basis of a first exemplary embodiment. In computer 10, a memory device (not shown), e.g. a CD-ROM, is provided on which geographical locus data are stored relating at least to the area in which surface 1 to be compacted is located. Such storage media are available e.g. for navigation systems in vehicles.

Via a GPS receiver (not shown), which for example can also be provided in position detection device 18, surface definition device 6 receives the indications required to determine the geographical locus information from the locus memory device and to represent this information on display 12. With the aid of input device 11, which can include a known mouse control unit or some other graphic input means, the operator defines the boundaries 2 of surface 1 to be compacted on display 12. In surface definition device 6, the graphic inputs from the operator are converted into absolute or relative locus coordinates, and are made available to path planning device 7.

Absolute locus coordinates, e.g. in the form of GPS coordinates, are particularly well-suited for a precise soil compacting of a larger surface. Alternatively, it is also possible to work with relative locus coordinates and, on the basis of a reference point, to input relative indications, such as distances, angles, and compass directions, with the aid of surface definition device 6.

The use of relative locus coordinates can be advantageous in particular if the determination of absolute locus coordinates (e.g. GPS coordinates) turns out to be difficult or too imprecise. In order to determine the relative locus coordinates, the position detection device can have for example a transmitter, situated in the vicinity of surface 1 to be compacted, that sends a particular signal out over surface 1. In addition, a second transmitter is advantageously set up that is spatially separated from the first transmitter and that also radiates a signal, so that a receiver belonging to position detection device 18 on soil compacting device 3 can determine the precise relative position, and if necessary the relative motion, to the transmitters by evaluating the signals (e.g. by determining interferences or phase differences). The second transmitter can also be formed by a transponder to which a second signal is not externally supplied and that merely returns the signal of the first transmitter, so that the expensive laying of cables to the second transmitter is omitted.

Of course, other devices and methods are also possible for determining the position of soil compacting device 3, as are known for example from maritime and aircraft technology, or more recently from vehicle navigation technology.

On the basis of mathematical algorithms, path planning device 7 determines a travel path on which vibration plate 3 must move in order to completely compact surface 1. As already described, here it is possible to indicate as a target determination for the path planning a spiral-shaped path, a meandering or strip-shaped course, or a zigzag movement of the path. Of course, here different movement schemata are possible that can be selected by the operator. The goal of the path planning is to travel completely over the surface 1 to be compacted at least once. In order to enable the achievement of a sufficient soil compacting, however, it is often required to travel over the surface several times. This requirement can also be taken into account in the path planning.

Soil compacting device 3 is brought by the operator to the surface 1 to be compacted, or to the vicinity of this surface, manually, e.g. with the aid of input device 9.

At the beginning of the compacting work, motion controller 8*a* in remote control device 5, or alternative motion controller 8*b* on soil compacting device 3, obtains on the one hand the data representing the predetermined travel path 4 from path planning device 7, and obtains on the other hand signals from position detection device 18, which informs motion controller 8*a*, 8*b* concerning the current position of soil compacting device 3. Via travel regulation device 15, motion controller 8*a*, 8*b* then introduces the corresponding measures to move soil compacting device 3 on the course determined by path planning device 7. If soil compacting device 3 deviates from the predetermined travel path 4, motion controller 8*a*/8*b* provides corresponding counter-regulation in order to compensate the deviation.

In this way, an automatic compacting of surface 1 is possible without requiring the operator to intervene in order to control the travel manually.

Input device 9 is available to the operator for emergency cases or for particular obstacles; this input device 9, in the manner of a classic remote control device, influences the travel behavior of soil compacting device 3 via receiver 14 and travel regulation device 15.

Alternatively, it is also possible to use input device 9 to subsequently modify the target value predetermined by motion controller 8*a*/8*b*, and only then to forward this target value to travel regulation device 15 in order to control vibration exciter 16.

For safety purposes, it is useful that input device 9 can at all times override the automatic controlling of soil compacting device 3. In this way, the operator retains the ability to control soil compacting device 3 at all times, independent of the automatic mechanism.

So that position detection device 18 can transmit its data to control device 5, it is useful if on the one hand receiver 14 is also fashioned as a transmitter, and on the other hand transmitter 13 is also fashioned as a receiver. In this way, a constant exchange of data is possible between control device 5 and soil compacting device 3, so that other information not relating to the present invention, such as e.g. motor speed, vibration frequencies, vibration amplitudes, oil temperature, data for determining the current state of compaction of the soil, etc., can be transmitted and displayed e.g. on display 12.

The spatial arrangement of the components of the control device/remote control device 5 is not as strict as is shown in FIG. 2. Thus, it is easily possible to situate at least some individual components of control device 5 directly on soil compacting device 3, if this is useful. It is also possible to situate the complete control device 5, i.e. including input device 11 and display 12, directly on soil compacting device 3. This can be useful in particular if the definition of the surface is to take place in a particularly simple manner, e.g. without the aid of GPS coordinates.

It is particularly helpful if the data of position detection device 18 are additionally stored in a memory device that is coupled to an evaluation device. The evaluation device is able to graphically display the data of position detection device 18, e.g. on display 12. In this way, it is possible for the operator relatively easily to monitor the already-traveled path of soil compacting device 3, and e.g. to compare it with predefined surface 1 or with the boundaries 2 of this surface. Likewise, the travel path 4 predetermined by path planning device 7 can be displayed on display 12, which improves the operator's monitoring ability. In any case, in this way it is possible for the operator to recognize whether vibration plate 3 has actually traveled over surface 1 in the desired manner.

Alternatively to a graphic representation, actual value protocols can also be produced that can be compared in written form with the target specifications.

Figure 3:
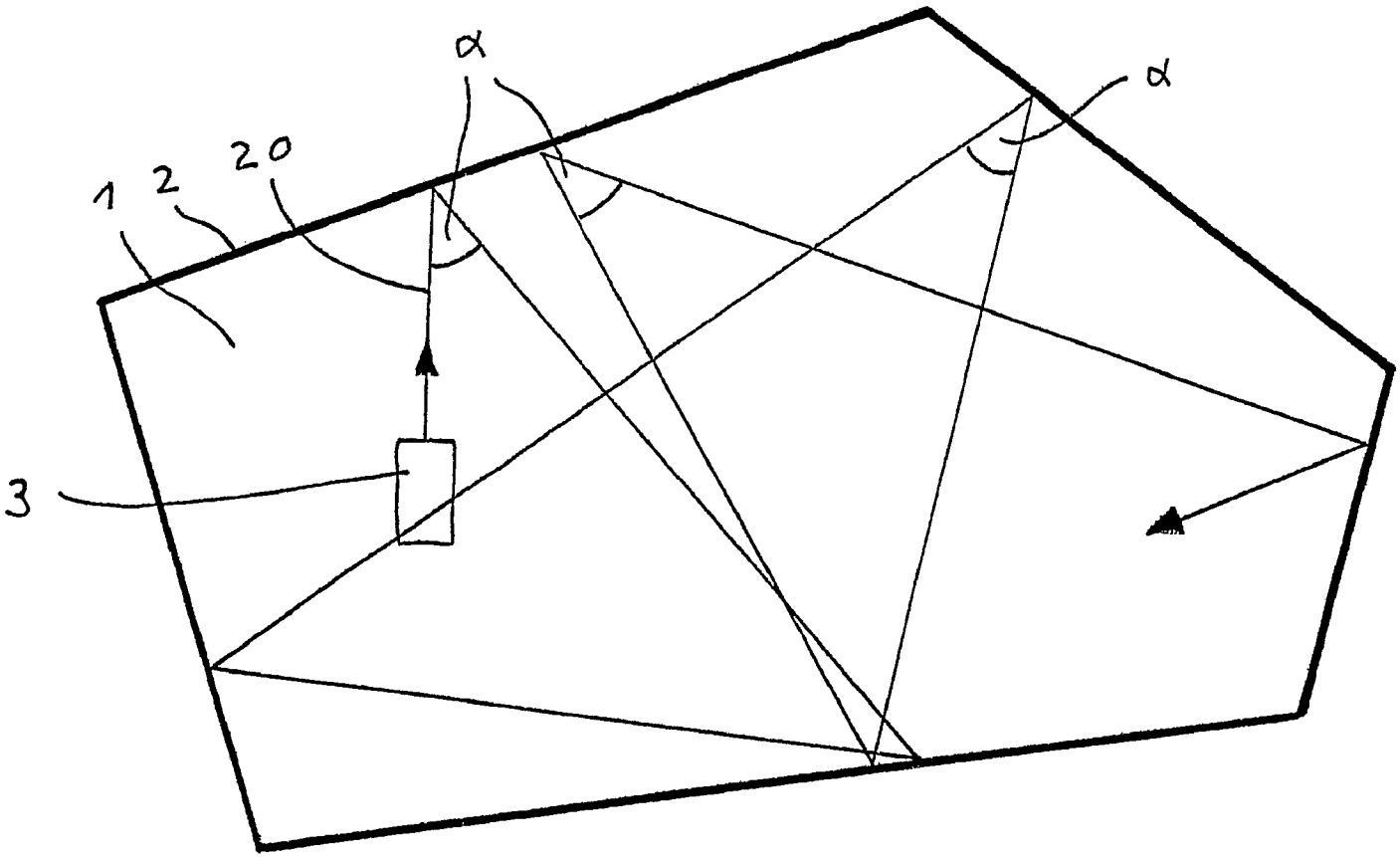
FIG. 3 shows a schematic representation of a surface to be compacted, for the explanation of a second specific embodiment of the present invention.
Figure 4:
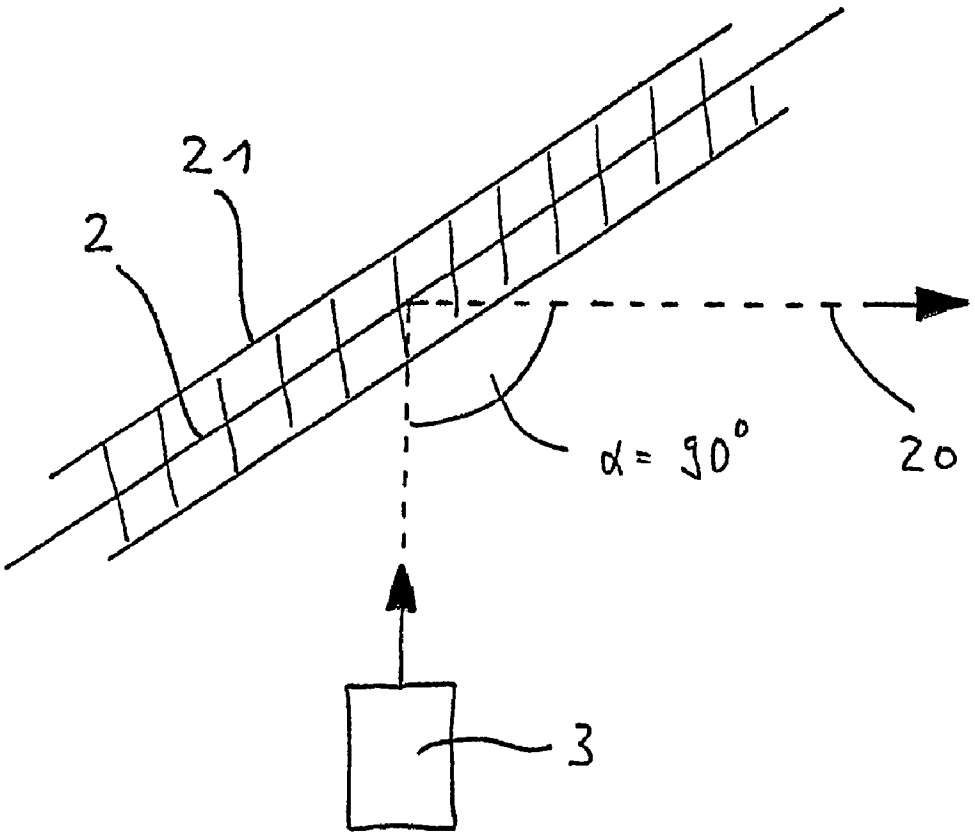
FIG. 4 shows a diagram for the explanation of the travel regulation in the second specific embodiment of the present invention.

On the basis of FIGS. 3 and 4, a second specific embodiment of the present invention is explained.

This variant has a simpler construction than the above-described first specific embodiment. In particular, here it is not required to permanently detect the current position of soil compacting device 3. Likewise, no path planning device is required. The definition of the surface 1 to be compacted with the aid of surface definition device 6 can also be carried out in a simplified manner.

The basic automatic soil compacting concept underlying the second specific embodiment is that the surface to be compacted is traveled more or less randomly by soil compacting device 3. Here, soil compacting device 3 preferably always travels in a straight line until it meets one of the surface boundaries 2. Having arrived there, it changes its direction of travel, and continues in a different direction within surface 1 until it again encounters a surface boundary 2. Over time, in this way this random principle will result in the automatic compacting of the entire surface 1.

FIG. 3 shows the movement of soil compacting device 3 in a straight line along a travel path 20. Upon reaching surface boundary 2, soil compacting device 3 changes its direction of travel, and continues to travel. The change of direction in the example shown in FIG. 3 is based on the following rule: soil compacting device 3 always turns to the right and changes its direction angle by 315°, so that travel path 20 encloses an acute turning angle $\alpha$ of 45°. Of course, arbitrary other angular settings, as well as other travel rules, are conceivable.

FIG. 4 shows the example of a turning angle $\alpha$ of 90°. However, an acute turning angle $\alpha$ has the advantage that surface 1 is compacted relatively quickly even according to a random principle, while at an angle of 90°, in particular if surface boundaries 2 stand at a right angle to one another, there is a danger that vibration plate 3 will always travel the same travel path 20.

The surface definition device can be constructed very simply in comparison to the first specific embodiment of the present invention. Thus, it is for example possible to identify surface boundaries 2 with the aid of a stretched wire, or by colored markings sprayed on the soil. Of course, other identification possibilities are conceivable that operate according to a mechanical, optical, magnetic, inductive, or capacitive principle. Thus, in particular in the case of rectangular surfaces, it is very easily conceivable to define surface boundaries 2 with the aid of photoelectric barriers.

On soil compacting device 3, a position detection device not shown in the Figures is provided that can likewise be constructed more simply than the above-explained position detection device 18 of the first specific embodiment of the present invention. This is because it is sufficient for the position detection device to detect only the current position of soil compacting device 3 in the vicinity of a surface boundary 2, i.e., an approach of soil compacting device 3 to surface boundary 2. It is not necessary for the position detection device to constantly detect the current position of soil compacting device 3.

Correspondingly, the position detection device can be equipped with a detector suitable for recognizing the above-defined surface boundaries 2.

When surface boundary 2 is reached, a motion controller (not shown) that differs from, and is simpler than, the above-described motion controller 8*a*/8*b* carries out a modification of a direction of travel corresponding to a predetermined rule. As presented above, it is for example possible always to provide a turning process in the same direction or with a particular angle. Alternatively, randomly selected angles can also be traveled. It must merely be ensured that after changing its direction of travel, soil compacting device 3 no longer has the tendency to cross surface boundary 2. Should this nonetheless be the case—e.g. given a fixedly predetermined change of direction with a constant angle with particular constellations of surface boundaries 2—the motion controller would immediately have to take corresponding additional control measures, for example a new change of direction according to the predetermined rules.

FIG. 4 shows that surface boundary 2 can include a border area 21 that permits a certain tolerance within which soil compacting device 3 must change its direction of travel.

As was already explained in detail in the introduction to the description, the soil compacting system according to the present invention preferably has a soil compacting device having stabilization of the travel direction, as is known for example from DE 100 53 446 A1. This is for example a vibration plate 3 having vibration exciter 16 that has two shafts 25, 26 that rotate in opposite directions, on each of which at least one imbalance mass is situated.

Advantageously, the soil compacting device is equipped with travel direction stabilization corresponding to DE 100 35 446 A1. However, this is not absolutely necessary. It is of course also possible for the soil compacting system to use a conventional soil compacting device, in particular a standard vibration plate, that does not have travel direction stabilization in the sense of DE 100 35 446 A1. The motion controller is then responsible for adhering to the travel path, and occasional deviations from the predetermined course are accepted.

Figure 5:
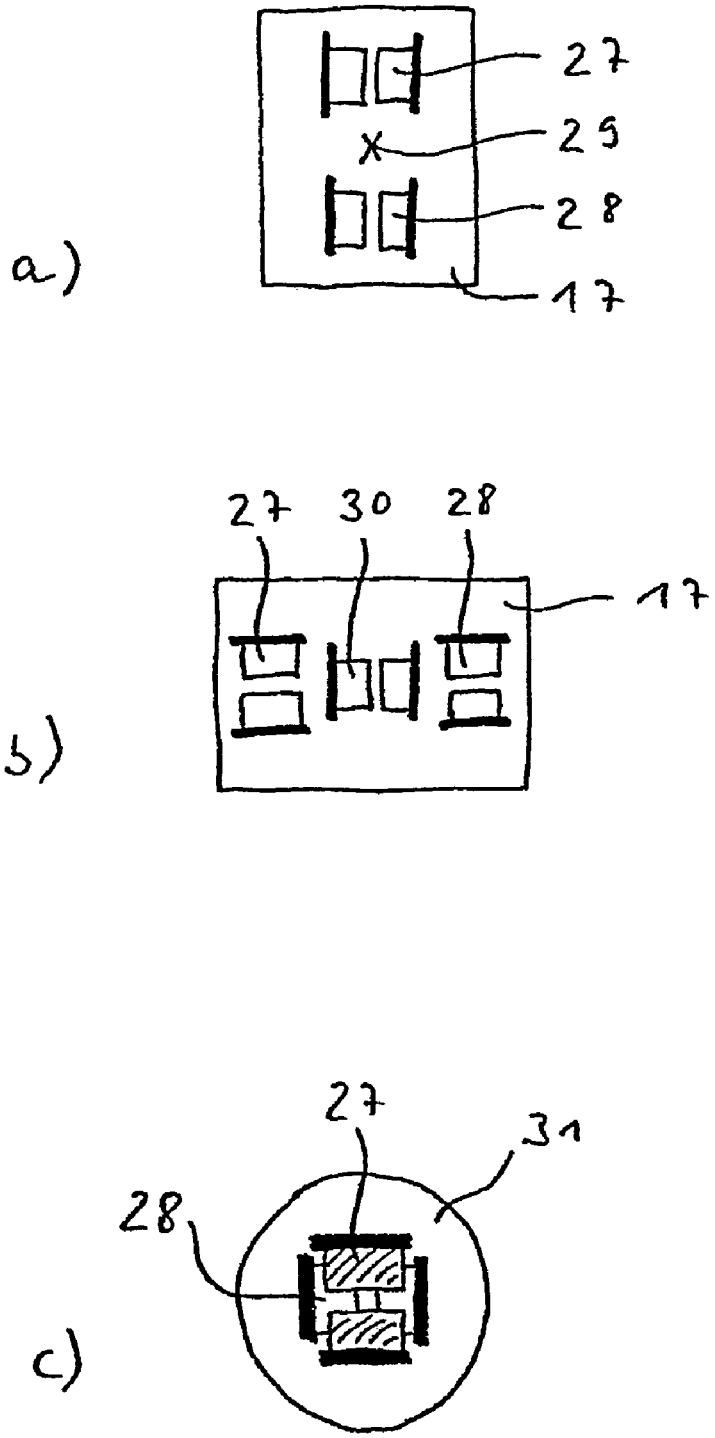
FIG. 5 shows various variants of a soil compacting device for the soil compacting system according to the present invention.

Based on DE 100 35 446 A1, soil compacting devices having more than one vibration exciter can also be used, as is shown for example in FIG. 5.

FIG. 5*a* schematically shows a top view of a vibration plate with soil contact plate 17, on which two vibration exciters 27, 28 are situated so as to be offset to one another. A vertical axle 29 is provided between vibration exciters 27, 28. It can be seen that when there is a different horizontal exertion of force, vibration exciters 27, 28 can produce a yaw moment about vertical axle 29.

In the variant shown in FIG. 5*b*, vibration exciters 27, 28 and, in addition, an additional vibration exciter 30 are situated on base plate 17 of a soil compacting device. Due simply to the fact that all three vibration exciters produce vertical oscillations, it can be seen that such a vibration plate is very well-suited for effective soil compacting. The steerability of the vibration plate is improved by the different directions of action of the vibration exciters—middle vibration exciter 30 is rotated by 90° in relation to the two other vibration exciters 27, 28.

Finally, in FIG. 5*c* a vibration plate is shown having a circular soil contact plate 31 on which two vibration exciters 27, 28 are situated one over the other and offset by 90° to one another. Such a vibration plate has no preferred direction in the sense of a forward or backward direction of travel, but rather can be adjusted universally in any direction. By controlling the phase positions of the imbalance masses of the individual vibration exciters 27, 28, almost any arbitrary direction of movement of the vibration plate can be realized. This is very advantageous in particular in combination with the soil compacting system according to the present invention, because the vibration plate can change its direction without having to rotate soil contact plate 31 in relation to the soil that is to be compacted.

In DE 100 35 446 A1, additional possibilities are described for the realization of a soil compacting device for particularly advantageous application in the soil compacting system according to the present invention.

The invention claimed is:

1. A soil compacting system, comprising:

a mobile, generally hand guided steerable soil compacting device; and a control device;

the control device including:

a surface definition device allowing a local operator to establish a surface to be compacted by locally defining associated surface boundaries;

a position detection device for detecting the current position of the soil compacting device, at least in the vicinity of the surface boundaries;

a path planning device for setting a predetermination for a travel path, on the basis of the defined surface area and on the compaction needs of the surface, in such a way that the soil compacting device travels over at least substantially the entire surface, a sufficient number of times to achieve complete compaction of the soil in the surface;

a motion controller for changing a direction of travel by predetermining a target value for a traveling movement of the soil compacting device, such that the soil compacting device does not cross the respective surface boundary, but rather continues its travel within the surface, along the predetermined travel path, the motion controller changing the direction of travel by adjusting operation of at least one vibration excitation device.

2. A soil compacting system according to claim 1, wherein the position detection device is fashioned at least for the detection of an approach of the soil compacting device to one of the surface boundaries;

the direction of travel can be changed by the motion controller if the position detection device determines an approach to the surface boundary.

3. A soil compacting system according to claim 2, wherein the surface definition device has a device for the mechanical, optical, magnetic, inductive, or capacitive identification of the surface boundaries.

4. A soil compacting system according to claim 3, wherein the surface identification device is for mechanical identification and has a tape or wire that can be stretched along the surface boundaries.

5. A soil compacting system according to claim 3, wherein the surface identification device is for optical identification and has coloring agents the can be applied to the soil along the surface boundaries.

6. A soil compacting system according to claim 3, wherein the surface identification device is for optical identification has a photoelectric barrier.

7. A soil compacting system according to claim 1, wherein the motion controller effects a change of the direction of travel from the original direction of travel with a predetermined angle ( ) that remains constant during the entire compacting process, or with angles that change during the compacting process and that are selected randomly.

8. A soil compacting system according to claim 1, wherein the control device comprises:

a path planning device for setting the predetermination for a travel path on the basis of the defined surface in such a way that the soil compacting device travels over the surface to be compacted completely at least once while adhering to the predetermined travel path; wherein the position detection device is fashioned for the detection of the current position of the soil compacting device within the surface boundaries, and the motion controller is fashioned for the predetermination of a target value for a travel motion of the soil compacting device based on a comparison of the current position with the predetermined travel path, in such a way that the soil compacting device follows the predetermined travel path.

9. A soil compacting system according to claim 8, wherein the surface definition device and/or the position detection device has a coordinate detection device for determining absolute geographical locus coordinates of its location.

10. A soil compacting system according to claim 8, wherein the surface definition device has a memory device containing geographical locus information for the region of the surface that is to be compacted.

11. A soil compacting system according to claim 8, wherein the surface boundaries are capable of being defined by absolute locus coordinates.

12. A soil compacting system according to claim 8, wherein the predetermination of the travel path by the path planning device is capable of being defined in the form of absolute or relative geographical locus coordinates.

13. A soil compacting system according to claim 8, wherein the path planning device has mathematical algorithms for path-optimized and/or time-optimized path planning.

14. A soil compacting system according to claim 8, wherein the surface definition device, the motion controller and/or the path planning device, is situated spatially separate from the soil compacting device.

15. A soil compacting system according to claim 8, wherein the surface definition device is situated spatially separate from the soil compacting device, and wherein data can be transmitted wirelessly via at least of radio, infrared, or laser between the surface definition device and the soil compacting device.

16. A soil compacting system according to claim 1, wherein an input device for manually modifying the target value predetermined by the motion controller is provided spatially separate from the soil compacting device, and is coupled thereto via a radio, laser, or infrared path.

17. A soil compacting system according to claim 1, wherein the position detection device is coupled to a memory device for storing data concerning the positions reached by the soil compacting device.

18. A soil compacting system according to claim 1, wherein an evaluation device is coupled to the surface definition device and to the position detection device, and has a display for the graphic representation of the predetermined surface boundaries and of the surface already compacted at a given time by the soil compacting device.

19. A soil compacting system according to claim 8, wherein a compaction result detection device is provided for detecting the actual state of compaction of the compacted soil;

the compaction result detection device is coupled to the path planning device for the communication of information relating to the actual state of compaction; and the path planning device is fashioned for the definition of the predetermination of the travel path, taking into account the actual state of compaction.

20. A soil compacting system according to claim 19, wherein the path planning device, the actual state of compaction can be compared with a predetermined target state of compaction;

the travel path can be predetermined by the path planning device in such a way that soil surfaces in which the actual state of compaction exceeds the target state of compaction, so that a sufficient compaction is already present, are no longer traveled over by the soil compacting device.

21. A soil compacting system according to claim 1, wherein the soil compacting device comprises:

a drive mechanism for producing an advance movement;

a steering device for producing a yaw moment about a vertical axle of the soil compacting device ; and a travel regulation device that can be charged with an actual travel movement value and the target value predetermined by the motion controller, for controlling the steering device and/or the drive mechanism in such a way that a control deviation formed by the difference between the actual travel movement value and the target value is minimal.

22. A soil compacting system according to claim 21, wherein the drive mechanism has at least one vibration-exciting device having two shafts that are parallel to one another and that can be rotated in opposite directions, each of which bears at least one imbalance mass, and whose phase position to one another can be adjusted.

23. A soil compacting system according to claim 21, wherein on at least one shaft of the vibration-exciting device two imbalance masses are situated so as to be axially offset to one another, and wherein the steering device is fashioned for the adjustment of the phase position of the two imbalance masses.

24. A soil compacting system according to claim 21, wherein the drive mechanism and the steering device are formed by a system of a plurality of vibration-exciting devices that are held stationary relative to one another, the vibration-exciting devices each having two shafts that are parallel to one another and that can be rotated in opposite directions, each shaft bearing at least one imbalance mass, the phase position of the shafts being adjustable, an advance movement being producible in a direction of advance by each of the vibration-exciting devices.

25. A soil compacting system according to claim 21, wherein the direction of advance of at least one of the vibration-exciting devices differs from that of the others.

26. A soil compacting system according to claim 21, wherein a soil contact plate charged by the vibration-exciting device or devices has an essentially circular outline.

27. A method for automated soil compacting, comprising the steps of:

locally defining surface boundaries of a surface to be compacted by a normally hand guided soil compacting device, using a locally positioned surface definition device;

planning a travel path of the compacting device, on the basis of the defined surface area and on the compaction needs of the surface, in such a way that the soil compacting device travels over at least substantially the entire surface a sufficient number of times to achieve complete compaction of the soil in the surface;

controlling at least one vibration excitation device to cause the soil compacting device to automatically travel along the travel path within the surface boundaries in a generally straight line such that the position of the compacting device relative to a work surface is defined solely by the surface boundary;

detecting an approach of the soil compacting device to one of the surface boundaries; and automatically modifying of the direction of travel of the soil compacting device from the generally straight line in such a way that the soil compacting device does not cross the respective surface boundary, but rather continues its travel within the surface in a direction crossing the generally straight line.

28. A method for automated soil compacting, comprising the steps of:

locally defining surface boundaries of a surface to be compacted by a normally hand guided soil compaction device by physically defining a perimeter of the surface to be compacted, and storing data representing the surface boundaries in a surface definition device;

planning a predetermination for a travel path on the basis of the defined surface area and on the compaction needs of the surface, in such a way that the soil compacting device travels over substantially the entire surface to be compacted at a sufficient number of times to achieve complete compaction of the soil in the surface while adhering to the predetermined travel path;

controlling at least one vibration excitation device of the soil compacting device to cause the soil compacting device to automatically travel along the predetermined travel path after the surface boundaries have been defined.

29. A method according to claim 28, wherein the automatic travelling step comprises the following steps:

detecting the current position of the soil compacting device;

comparing the current position with the predetermined travel path; and automatically travelling and steering the soil compacting device in such a way that the soil compacting device follows the predetermined travel path.

30. A method according to claim 29, further comprising:

continuously detecting the actual state of compaction of the compacted soil;

comparing the actual state of compaction with a target state of compaction;

compensating the predetermined travel path in such a way that areas of the soil in which the actual state of compaction is greater than the target state of compaction are no longer traveled over by the soil compacting device.

* * * * *